US005570577A

United States Patent [19]

Dziedzic

[11] Patent Number: 5,570,577

[45] Date of Patent: Nov. 5, 1996

[54] ANCHOR TORQUE CONTROLLER FOR ANCHOR INSTALLING MACHINES

[75] Inventor: Edward Dziedzic, Germantown, Tenn.

[73] Assignee: Dixie Electrical Manufacturing Company, Memphis, Tenn.

[21] Appl. No.: 526,688

[22] Filed: Sep. 11, 1995

[51] Int. Cl.[6] ..... F16D 31/02

[52] U.S. Cl. ..... 60/468; 60/494; 91/59

[58] Field of Search ..... 91/59; 60/468, 60/459, 494

[56] References Cited

U.S. PATENT DOCUMENTS

| | | | |
|---|---|---|---|
| 3,785,157 | 1/1974 | Kittle et al. | 60/494 X |
| 3,890,788 | 6/1975 | Habiger | 60/494 X |
| 4,362,018 | 12/1982 | Torii | 60/468 |
| 4,644,748 | 2/1987 | Goss, Jr. et al. | 60/494 X |
| 4,850,192 | 7/1989 | Mitsumasa et al. | 60/494 X |
| 4,986,075 | 1/1991 | Shimoie | 60/468 |

*Primary Examiner*—Hoang Nguyen
*Attorney, Agent, or Firm*—Paul M. Denk

[57] ABSTRACT

A torque controller which limits the output of a hydraulic motor is provided. The torque controller includes a by-pass circuit which allows the hydraulic fluid in the hydraulic fluid circuit to by-pass the motor. A valve manifold is placed in the by-pass and includes a main chamber having a main valve member and one (and preferably two or more) poppet valves in communication with the main chamber. The pressure at which the poppet valves and the main valve open are individually adjustable and are set for different pressures. Inlets to the poppet valves are closed with electrically operated solenoids such that the inlet to a selected poppet valve can be opened to activate that poppet valve.

4 Claims, 2 Drawing Sheets

ANCHOR TORQUE CONTROLLER FOR ANCHOR INSTALLING MACHINES

BACKGROUND OF THE APPLICATION

This invention relates to machines for installing ground anchors such as are used to stabilize utility poles, and in particular to a torque controller for the anchor installer.

Ground anchors are typically driven into the ground by a hydraulically driven motor. The motor rotates a Kelly bar and hardware connectors which engage the anchor. As the Kelly bar and hardware connectors are rotated by the hydraulic motor, the anchor is driven into the ground.

The utility personnel who typically install anchors often do not understand the torque to pull-out capacity relationship and thus many anchors are installed incorrectly. These incorrect installations can pull out of the earth at reduced load levels and present a safety hazard or can cause electrical lines to fall to the ground. Standards for these installations are usually known to the utility standards engineer, but installers do not consistently achieve the installed torque. This is due primarily to the unavailability of suitable torque devices or because the torque devices available are too difficult to use. For example, a shear pin is often used. The shear pins, however, will be subjected to forces during use which will weaken the pins. The use of shear pins thus requires constant changing of pins during an installation procedure.

In addition to the known need for a minimum torque on a given anchor installation for pull-out capacity, a problem exists when the torque exceeds the manufacturers torque design limit for the anchor being installed. Such high torque installations frequently break the anchor or the drive mechanisms during installation, creating the problem of unknowingly leaving a partially broken anchor in the ground, creating a pull-out safety risk. Further, the anchors are often capable of withstanding more force than the driving tool. For example, whereas an anchor can withstand up to 15,000 to 18,000 foot-pounds of torsional force when driven into the ground, the tools that are used to drive the anchor into the ground (e.g. an installing wrench tube) may only withstand 10,000 foot-pounds. When the anchor is installed, the installer may check the anchor for its rating, but often does not check other components of the drive assembly. Thus, the other components can be driven beyond their capabilities. The driving tools may thus break, shear off connecting bolts, and send parts flying. These flying parts form projectiles which may cause injury.

The hydraulic motors used are ever increasing in their torque capacity. While high torque is needed for the hole auguring function of the motor, the torque output by the motor may need to be limited for other applications.

There are devices available which measure the torque but do not provide a means of controlling the maximum torque during installation. For example, the shear pin can limit torque, but, as noted above, it is difficult to use and is limited in its mechanical capacity. Further, the shear pin controls only the torque applied to the anchor and does not control the torque output by the motor to reduce the torque when the torque exceeds a desired value. Shear pins are also known to have maintenance problems during sustained use, a problem which tends to discourage its use.

SUMMARY OF THE INVENTION

One object of the present invention is to provide a hydraulic motor for installing a ground anchor.

Another object is to provide a means for limiting and controlling the torque of the motor.

Another object is to provide such a torque controlling means which is adjustable.

Another object is to provide such a torque controlling means in which the torque can be limited according to more than one variable.

These and other objects will become apparent to those skilled in the art in light of the following disclosure and accompanying drawings.

In accordance with the invention, generally stated, a torque limiter/controller is provided which can be placed in the hydraulic circuit of a hydraulic motor and which can control the output of the motor by controlling the pressure within the hydraulic circuit. The torque controller includes a by-pass circuit which by-passes the motor and a valve manifold in the by-pass circuit. The valve manifold has an inlet and an outlet and includes a main valve chamber, at least one, and preferably two or more, poppet valves in communication with the main valve chamber. A main valve member positioned in the main chamber to be movable within the chamber between a closed position in which the member closes the outlet to prevent fluid flow though the manifold and an open position in which the member is spaced from the outlet to allow fluid flow through the chamber. A guide member radiates from the top of the valve member. An adjustment plate is positioned in the main chamber to be above the main valve member. A spring is positioned between the plate and the guide to normally bias the valve member closed. The position of the plate in the chamber can be adjusted using a screw or bolt which extends from the valve body to adjust the pressure at which the main valve element will be moved from the closed to the opened position.

The poppet valves each have an inlet, an outlet, a poppet valve chamber, and a poppet valve member movable in the chamber between an open position and a closed position. The poppet valve inlets and outlets are in communication with the outlet of the main chamber. The poppet valve members have radially extending flanges or guides. An adjusting plate is received in each poppet valve chamber behind the poppet valve member and a spring is positioned between the plate and the poppet valve member to bias the poppet valve member normally closed. The position of the plate is adjustable to adjust the pressure at which the poppet valve will open.

The torque controller is operated by setting the pressure for each valve member differently, such that the valves will be opened by different pressures.

The inlet of each poppet valve is closed by a solenoid operated plunger. Thus, unless the solenoid is operated to open the inlet, the valve will be effectively deactivated. The solenoids are operatively connected to a switching circuitry which allows an operator to selectively activate one or none of the solenoids to select which of the two poppet valves will be used.

DESCRIPTION OF THE PREFERRED EMBODIMENT

Figure 1:
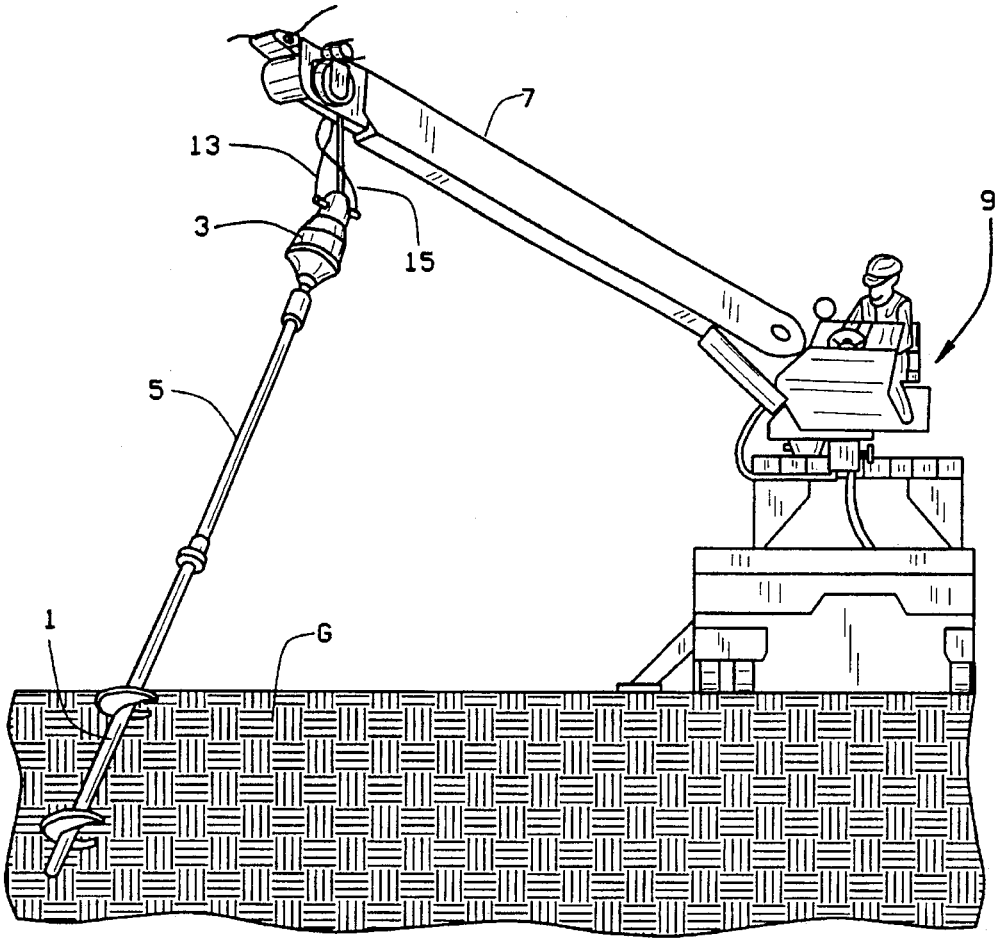
FIG. 1 is a side elevational view of an anchor installation, showing an anchor being driven into the ground.
Figure 2:
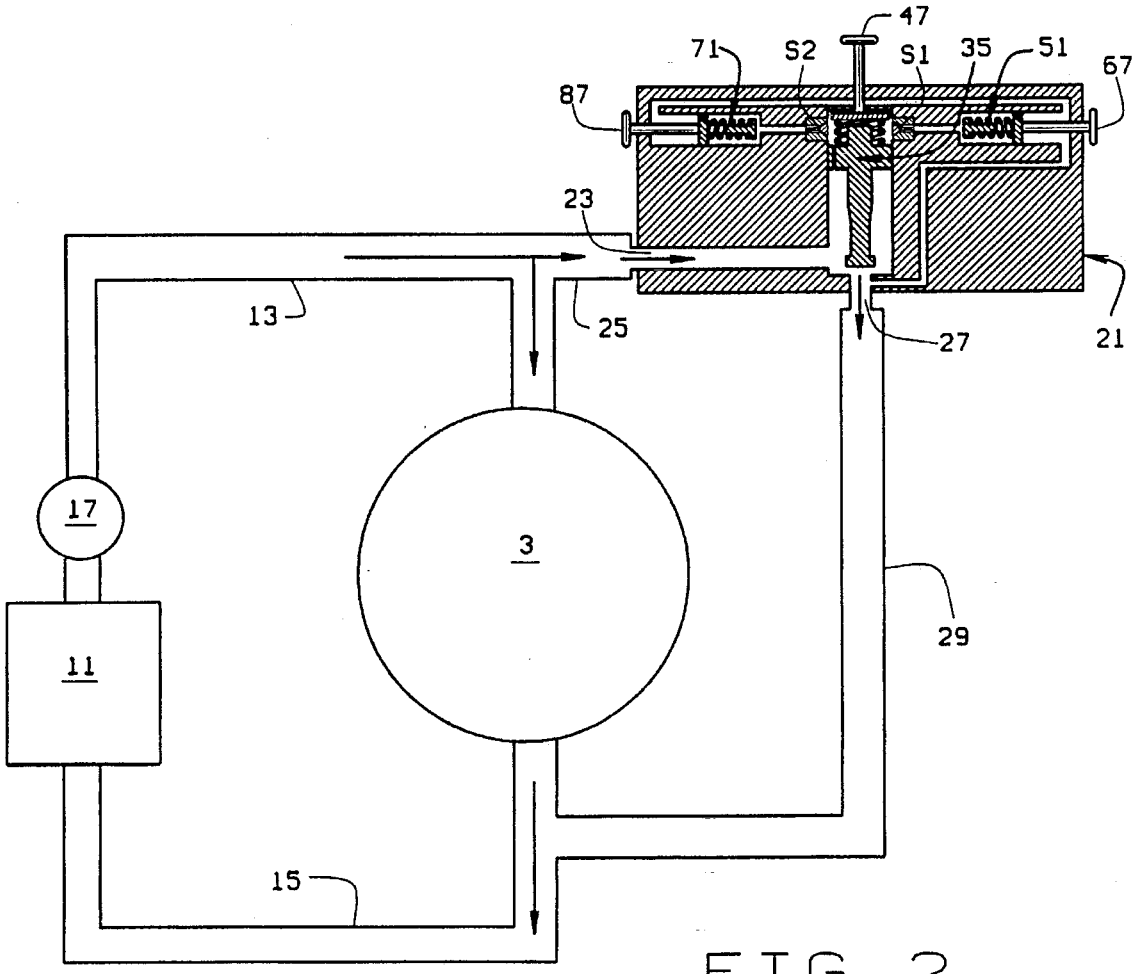
FIG. 2 is a block diagram of a hydraulic motor torque controller of the present invention.

Referring initially to FIG. 1, a ground anchor 1 is driven into the ground G by a motor 3 which is generally a hydraulic motor. A Kelly bar 5 is secured to the output of motor 3 and connected to the anchor 1 via appropriate hardware adapters, wrenches, etc. The motor 3 thus rotates the Kelly bar 5 to drive the anchor 1 into the ground. The motor 3 is generally suspended at the end of an arm 7 of a vehicle 9. Turning to FIG. 2, the vehicle 9 has a reservoir 11 of hydraulic fluid, fluid lines 13 and 15 which direct the fluid to the motor 3 and return the fluid to the reservoir 11, and a pump 17 which pumps the hydraulic fluid to drive the motor.

A pressure relief valve manifold 21 is provided to isolate the motor 3 from the digger/installer hydraulic circuit. Valve manifold 21 is operable, as described below, to reduce the hydraulic pressure in the motor circuit to reduce the torque created or output by the motor 3. The reduction in pressure is achieved without the need to bleed fluid from the hydraulic circuit. Rather, as described below, the size or volume of the circuit is increased to reduce the pressure. The valve manifold 21 has an inlet 23 connected to fluid line 13 by a line 25 and an outlet 27 connected to the return line 15 by a line 29. The valve manifold 21 and lines 25 and 29 form a by-pass circuit which will allow some the hydraulic fluid to by-pass the motor when the motor exceeds a desired torque to limit the torque of the motor to the desired torque. The valve manifold 21 thus controls the torque of the motor without the use of mechanical torque limiters, such as shear pins. Shear pins, however, can still be used as a fail safe if desired.

Figure 3:
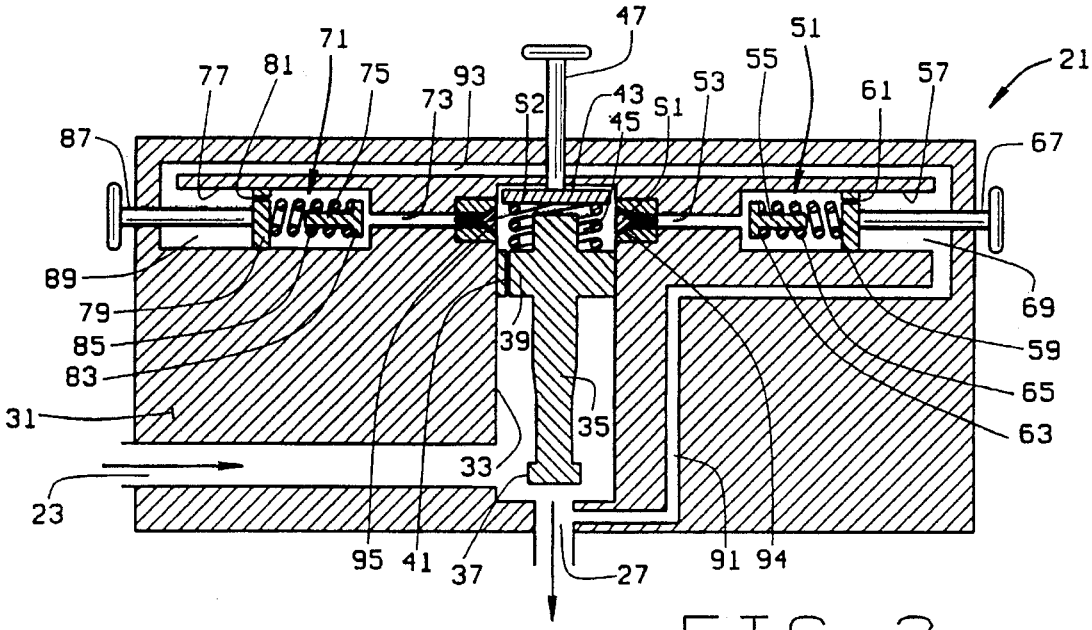
FIG. 3 is an enlarged cross-sectional block diagram of a pressure responsive valve used in the controller.

Turning to FIG. 3, the valve manifold 21 has body 31 in which inlet 23 and outlet 27 are formed. The inlet 23 and outlet 27 lead to and from a main chamber 33. A valve element or plug 35 having a nose 37 is received in chamber 33 to be movable between a closed position in which nose 37 seats on and closes outlet 27 and an open position in which nose 37 is spaced from outlet 27 to allow hydraulic fluid to flow through the by-pass circuit. The valve plug 35 includes a guide arm or flange 39 formed part way up the body. A port 41 is formed in the flange to allow fluid to pass through the flange 41 to fully fill the main chamber 33. A plate 43 is positioned above plug 35. Plate 43 is secured in body 31 to be stationary when the valve 21 is in use, yet be adjustable within chamber 33 relative to body 39. A spring 45 is positioned between the plate 43 and flange 39. The spring 45 normally biases the valve plug 35 to its closed position. A threaded screw or bolt 47 is connected to plate 43 and extends from valve body 31. Bolt 47 is operable to change the position of plate 43 and hence the compression of spring 45 to adjust the pressure necessary to move valve plug 35 from the closed position to the open position.

Two generally identical poppet valves 51, 71 communicate with the main valve chamber 33 via inlet passages 53, 73. Passages 53, 73 are preferably positioned above the flange 39 of valve element 35 to open into the area between the flange 39 and the adjusting plate 43. The passages 53, 73, however, could be positioned elsewhere, as long as they will not be blocked by the flange 39 of the valve element 35. Each poppet valve includes a valve element 55, 75 movable in a chamber 57, 77 between a closed position in which valve elements 55, 75 close passages 53, 73 and an open position in which fluid can flow through the passages 53, 73. Plates 59, 79 are positioned in chambers 57, 77 behind valve elements 55, 75. Plates 59, 79 may be moved relative to the valve elements to adjust the position of the plates relative to the valve elements. Flow through ports 61, 81 are formed in the plates 59, 79. The valve elements 55, 75 have flanges 63, 83 and springs 65, 85 are positioned between plates 59, 79 and flanges 63, 83 to normally bias the valve elements to their closed positions. Threaded screws, bolts, or the like 67, 87 extend from the valve body 31 and are operably connected to their respective plates to alter the position, and hence the compression of the springs 65, 85. Using the screws 67, 87, the amount of pressure required to open valves 51, 71 can thus be altered.

The valves 51, 71 each have an outlet 69, 89 which communicates with a passage 91 to direct fluid to main chamber 33 and outlet 27. The outlet 69 of valve 51 is in direct communication with passage 91. Passage 91 will not be closed when the valve element 39 is in its closed position. Thus fluid will be able to flow from passage 91 though outlet 27 and into the line 29, even when valve element 35 is in its closed position. A passage 93 is provided to place the outlet 89 of valve 71 in communication with passage 91. Passage 91 is in direct communication with outlet 27.

The three valve elements 35, 55, and 75 open in response to desired pressures set using the screws or bolts 47, 67 and 87. The valve manifold 21 preferably operates to limit the torque output by the motor to one of three desired torques: (1) a minimum torque corresponding to a known minimal pullout requirement for the anchor installation; (2) a manufacturer's maximum recommended torque for the anchor to prevent damage to the anchor; and (3) an adjustable high limit torque for normal digging functions. The first setting depends on the soil type and would be set by or according to the instructions of a utility standards engineers. The third setting would effectively operate as a by-pass of the valve. Preferably, the poppet valves 51, 71 are set for the first two of the desired limits, and the valve element 35 is set to operate in the third position.

Figure 4:
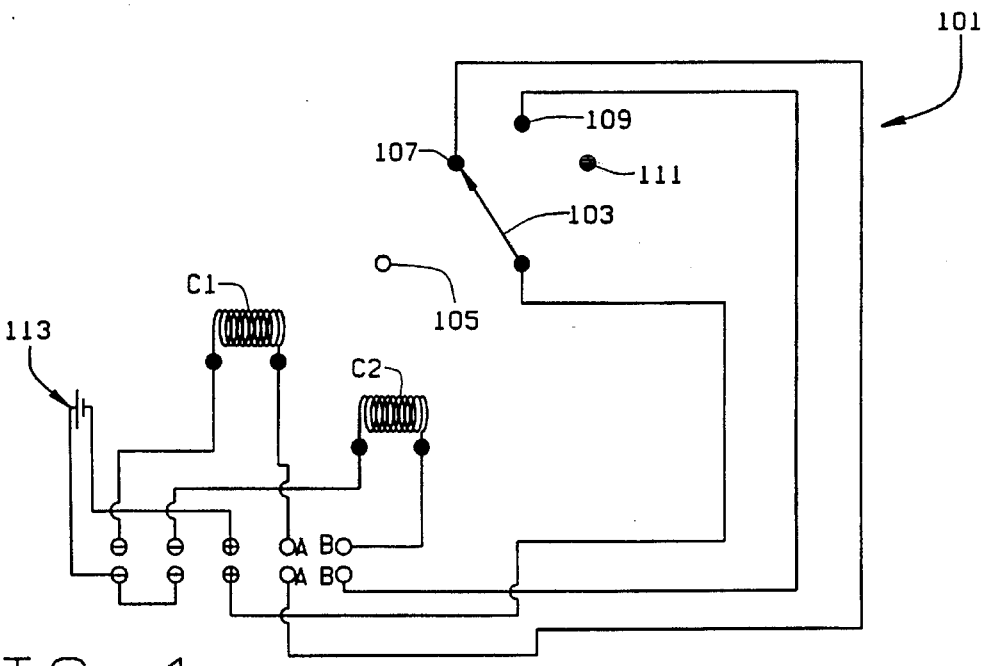
FIG. 4 is an electrical schematic of a switching circuit used to control a solenoid operated valve, similar to the valve of FIG. 3.

The passages 53 and 73 from the main chamber 33 to the poppet valves 51 and 71 are closed by solenoids S1 and S2. Each solenoid has a head 94, 95 which is sized and shaped to close the passages 53 and 73 to prevent fluid from flowing through the passages. The solenoids are normally closed to normally prevent the flow of fluid through the passages. The solenoids are activated by a switching circuit 101 shown schematically in FIG. 4. The switching circuit 101 has a switch arm 103 which is movable between four contacts: an off-contact 105, a first-contact 107, a second contact 109, and a third contact 111. The contact 107 is electrically connected to a first coil C1 which is wound around a shaft of the first solenoid element S1. The second contact 109 is electrically connected to a second contact C2, which is wound about the shaft of the second solenoid S2. The circuit also includes a source 113 of electrical energy, such as a battery, generator or plug to connect the circuit to a source of electricity. The battery 113 is connected on one side to a base of the switch arm 103 and on another side to the switch contacts 107 and 109 through coils C1 or C2. Thus, the solenoids S1 and S2 can selectively be activated depending on the position of the switch arm 103. The third contact 111 is not connected to either contact, and thus neither coil is activated when the switch is placed in contact with contact 111.

In operation, the three desired torque limits are set for the valves 51 and 71 and the main valve 33 by positioning the plates 43, 59, and 79. The high limit torque is set by adjusting the screw 47 of the main valve body 35. The relationship between pressure drop and torque is known for the motor used, and the valve can be calibrated at the factory based on pressure. Thus, the shaft of the screw 47 preferably has calibration markings on it so that the torque limit can be set. The valves 51 and 71 are similarly adjusted using their respective adjusting screws 67 and 87 respectively.

At the work site, prior to activating the motor, the desired torque limit is chosen by switching the switch 101 to the desired contact, to open the selected solenoid and effectively activate the desired valve, such that the hydraulic fluid will enter into the inlet of the selected or activated valve. If the switch is positioned to activate the coil C1, the solenoid S1 will be activated to allow fluid to flow through passage 53. Passage 73 will remain closed. If the switch is positioned to activate the coil C2, the solenoid S2 will be activated to allow fluid to pass though passage 73. Passage 53 will remain closed. If the switch arm is placed against contact 111, neither coil will be activated and the valves 51 and 71 will be effectively turned off.

As hydraulic fluid circulates, it enters the valve 21 through opening 23 and fills the main chamber 33 of the valve manifold. The port 41 in the flange 39 of valve body 35 allows the fluid to fully fill the main chamber 33. As the pressure reaches the torque limit of the activated valve, the selected or activated valve 51 or 71 will open, allowing the hydraulic fluid to flow through passage, 91 or 93, in the valve manifold 21. This will provide a momentary slight drop in the pressure (and hence the torque output) the first time the valves are opened, as a portion of the hydraulic fluid flows through line 29, by-passing the motor 3. This will allow the fluid to flow through by-pass tube 29 which will increase the volume the hydraulic fluid can fill and hence reduce the pressure in the hydraulic circuit. The torque output will then be decreased. When the pressure falls below the limit, the activated valve, 35, 51 or 71, will be urged to its closed positions by its respective spring 45 and 65 or 85. When the pressure again reaches the set limit, the activated valve will open to again allow the pressure to increase in main chamber 33 to force valve body 35 to its open position. When the pressure drops below the limit, the fluid in by-pass tube 29 passes through the tube, and by-pass tube 29 is essentially empty. Thus, on the second and successive openings of the valve exit 27, the by pass tube 29 will be empty, allowing the hydraulic fluid to fill a greater volume, hence reducing the pressure. As can be appreciated, the valve manifold 21 provides momentary reductions in pressure which keep the pressure in the hydraulic circuit, and hence the torque output by motor 3 at a desired maximum. The poppet valves act in a complementary fashion with spring 45 keeping the back (closing) pressure more smoothly regulated as compared to spring 45 acting alone.

By limiting the pressure in the hydraulic circuit to a desired maximum, the motor output is effectively controlled and kept at or slightly below a desired maximum output. The shear pins, and other mechanical torque limiters, do not need to be relied upon, and can be used merely as backups or fail-safes. This thus provides a method of controlling the torque output of the motor without frangible or breakable elements which have to be constantly replaced. Insertion of ground anchors can thus be performed more quickly.

As variations within the scope of the appended claims may be apparent to those skilled in the art, the foregoing description is set forth only for illustrative purposes and is not meant to be limiting. For example, although the valve 21 is shown with two poppet valves, more valves could be included to allow for more pressure or torque settings. This example is merely illustrative.

I claim:

1. A ground anchor installing machine, the installing machine including a hydraulic fluid circuit having a reservoir of hydraulic fluid, a hydraulic motor, a high pressure line which directs hydraulic fluid to said motor, a low pressure line which returns hydraulic fluid from the motor to the reservoir, and a pump which pumps the hydraulic fluid; the hydraulic motor being adapted to operatively drive a ground anchor to embed the ground anchor in the earth; the ground anchor installing machine further including a torque controller for limiting the torque output by the hydraulic motor; the torque controller comprising a by-pass circuit which by-passes said motor and a valve manifold in said by-pass circuit, said valve manifold having an inlet and an outlet and including:

a main valve chamber in fluid communication with said inlet and outlet; a main valve member positioned in said chamber to be movable within the chamber between a closed position in which said member closes said outlet to prevent fluid flow though said manifold and an open position in which said member is spaced from said outlet to allow fluid flow through said chamber; a flange on said member; a plate in said chamber to be positioned above said main valve member, a spring between said plate and said flange, the position of the plate in the chamber being adjustable to adjust the pressure at which the main valve element will be moved from the closed to the opened position; said main valve member being normally closed by said spring; and at least one poppet valve; said at least one poppet valve having an inlet, an outlet, and a poppet valve chamber, said poppet valve inlet being in fluid communication with said main chamber and said poppet valve outlet being in fluid communication with said outlet of said manifold, a poppet valve member received in said poppet valve chamber to be movable between an open position in which fluid may flow from said main chamber into said poppet valve chamber and a closed position in which fluid is prevented from flowing into said poppet valve chamber from said main chamber; said poppet valve member including a radially extending flange; a plate received in said poppet valve chamber behind said poppet valve member, a spring positioned between said plate and said poppet valve member to bias said poppet valve member normally closed; the position of said plate being adjustable;

wherein the pressure setting for said at least one poppet valve is different from the pressure setting for said main valve member.

2. The ground anchor installing machine of claim 1 wherein the torque controller includes at least two of said poppet valves, each of said poppet valves being set for a different pressure; the inlet of a first of said at least two poppet valves being normally closed by a first solenoid operated plunger and the second of said at least two poppet valves being normally closed a second solenoid operated plunger; said first and second solenoid operated plungers being electrically connected to a multi-position switch to move a desired plunger from a closed position to an open position.

3. The ground anchor installing machine of claim 2 wherein the torque controller includes a threaded bolt extending from a back surface of each of said plates to be external of said valve manifold, the position of said plates being selectively adjustable by rotation of said bolts.

4. The ground anchor installing machine of claim 3 wherein the torque controller includes indicia on said bolts, said indicia being calibrated such that a desired pressure setting can be obtained.

* * * * *